US005259787A

United States Patent [19]

Byrne

[11] Patent Number: 5,259,787

[45] Date of Patent: Nov. 9, 1993

[54] MOUNTING ASSEMBLY

[76] Inventor: Norman R. Byrne, 2736 Honey Creek, NE., Ada, Mich. 49301

[21] Appl. No.: 926,718

[22] Filed: Aug. 7, 1992

[51] Int. Cl.[5] ..... H01R 13/60

[52] U.S. Cl. ..... 4/532; 439/557

[58] Field of Search ..... 439/248, 532, 544, 549, 439/557, 571

[56] References Cited

U.S. PATENT DOCUMENTS

| | | | |
|---|---|---|---|
| 2,023,083 | 12/1935 | Knell . | |
| 3,573,716 | 4/1971 | Garver . | |
| 3,617,989 | 11/1971 | Heath . | |
| 3,812,450 | 5/1974 | Simovits, Jr. et al. . | |
| 3,970,276 | 7/1976 | Debaigt . | |
| 3,989,343 | 11/1976 | Lucius et al. . | |
| 4,062,470 | 12/1977 | Boteler . | |
| 4,214,668 | 7/1980 | Neff et al. . | |
| 4,500,746 | 2/1985 | Meehan . | |
| 4,541,036 | 9/1985 | Landries et al. . | |
| 4,612,603 | 9/1986 | Cook . | |
| 4,747,506 | 5/1988 | Stuchlik, III . | |
| 4,775,328 | 10/1988 | McCarthy . | |
| 4,887,978 | 12/1989 | Murakami | 439/557 X |
| 4,992,054 | 2/1991 | Cassan | 439/571 X |
| 4,993,576 | 2/1991 | Byrne . | |

FOREIGN PATENT DOCUMENTS 2316582 10/1973 Fed. Rep. of Germany .

OTHER PUBLICATIONS

"AMP Products for the Office of the 80'S . . . and Beyond," AMP Incorporated, Product Brochure.

"Electri-Pak 7," Electri-Cable Assemblies, Inc., Product Brochure.

*Primary Examiner*—Eugene F. Desmond

*Attorney, Agent, or Firm*—Varnum, Riddering, Schmidt & Howlett

[57] ABSTRACT

An electrical junction block mounting assembly includes a cantilever beam formed on an outer wall of the junction block and is provided with a transversely extending channel for engagement with a support structure. The cantilever beam is attached to the junction block by means of a resilient hinge section and is provided with a first arm section extending between the hinge section and the channel and a second arm section extending beyond the channel. The first arm section has a sloping surface sloping away from the outer wall between the hinge section and the channel, and the second arm section has a sloping surface sloping toward the wall beyond the channel. The sloping surfaces will contact a mounting rail or similar support structure during installation of the junction block thereby deflecting the hinged cantilever beam until the rail is in alignment with the channel for engagement with the structural support member.

13 Claims, 4 Drawing Sheets

MOUNTING ASSEMBLY

BACKGROUND OF THE INVENTION

1. Field of the Invention

The invention relates the apparatus from mounting electrical junction blocks and the like and more particularly to an arrangement for mounting such devices in confined areas such as electrical raceways.

2. Description of Related Art

Modern office arrangements often employ removable wall panels or the like to define work areas. Such panels and other structures often have a raceway area for accommodating electrical wiring and electrical junction blocks near the floor or in other locations which do not provide easy access to technicians. Typically, junction blocks are mounted within such raceway areas by attaching them to support brackets. Since the electrical wiring requirements and locations of the junction blocks, some of which may include outlet boxes and the like, depend on the everchanging needs of the users, junction blocks are often installed or removed after the wall panels structures are in place. Installing or removing a junction block positioned, for example, near the bottom of a wall panel and essentially at floor level, is often an arduous task. Furthermore, the only convenient access to a wall panel may be from only one side. Therefore, it is desirable that junction blocks are easily insertable and removable and that they be insertable and removable from either side of the wall panel.

U.S. Pat. No. 4,993,576 issued February 1991 to the inventor of the present invention shows a latching mechanism comprising a pair of opposing interlocking members hingedly attached to a junction block and arranged to define a channel between opposing edges for engaging a retainer tab. A similar device is disclosed in U.S. Pat. No. 5,051,203 issued May 14, 1991 to Furrow. Junction blocks are typically constructed by adjoining two complementary, separately molded, half sections and the latching arrangement typically has one of the engaging sections molded as an integral part of one half section and the opposing part molded as an integral part of the other half section. The prior art latches comprise opposing and interlocking tongues and grooves. Unless special precautions are taken in the manufacture of these parts, the opposing sections may not be properly aligned resulting in improper operation of the latch arrangements. A further disadvantage of the prior arrangement is that a grooved section defined between the opposing edges tends to be reduced in size when the interlocking members are depressed, causing a binding of the plate retained between the opposing edges of the interlocking members.

SUMMARY OF THE INVENTION

These and other problems of the prior art are overcome in accordance with this invention by a latch member comprising a cantilever beam hingedly supported at one end on an outer wall of the junction block or the like and having a slotted section forming a transversely extending channel in the beam for engagement with a retainer plate or the like. An arm section extends between the hinge end and the slotted section, and a further arm section extends away from the supporting end beyond the slotted section. The two arm sections have sloping exterior surfaces, sloping toward the channel, which cause the beam to be flexed toward the outer wall when brought into contact with a retainer plate or the like. The beam is constructed of a resilient material and moves away from the outer wall when the retainer plate or tab is aligned with the slotted area thereby securing engagement of the latch member with the support structure.

Advantageously, the sloping surfaces of the two arm sections on the latch member of this invention allow insertion from either side of a panel or the like. Furthermore, the present invention has an advantage over prior art devices in that it avoids the binding problem encountered in some prior art latches since the dimensions of the slotted area are not varied when the latch is depressed. Additionally, the latch of the present invention is easier to manufacture when a junction block is constructed of a bipartite structure comprising two separately molded half sections since the complete latch of this invention is on one of the two half sections and the problems of alignment inherent in prior art latches with interlocking members on separately molded sections is avoided.

In one specific embodiment of the invention, the junction block is adapted to be mounted between a pair of opposing support rails, and a junction block housing is provided with rail engaging arrangements on opposing outer surfaces to engage the opposing support rails. In one specific embodiment, at least one cantilever beam latch member is provided on each of the outer walls of the junction block to engage the opposing support rails. Additionally, spacing shoulders, protruding from the outer surfaces, in substantial alignment with the transversely extending channel of the cantilever beam assure a spacing between the outer walls and the support rails. In another embodiment of the invention, one of the outer surfaces of the junction block is provided with at least one cantilever beam and the other surface is provided with a rail engaging tab having a pair of arms which extend over a portion of one of the support rails and serves to retain the junction block in proper position relative to that one support rail.

BRIEF DESCRIPTION OF THE DRAWING

An illustrative embodiment of the invention is described in detail with reference to the drawing, in which.

DETAILED DESCRIPTION

Figure 1:
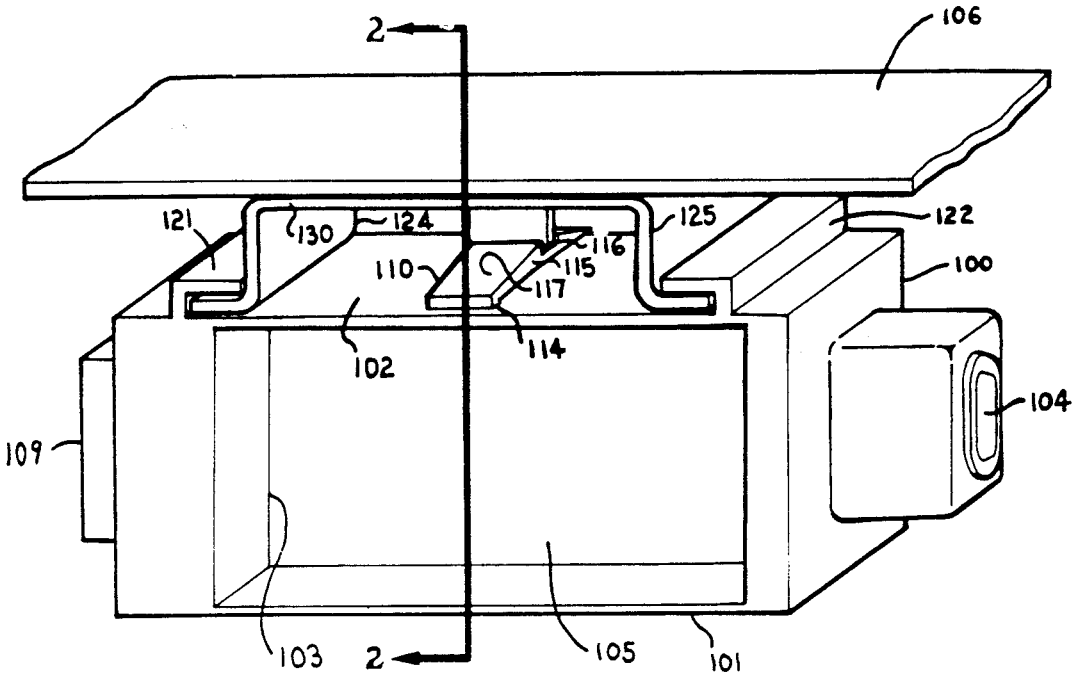
FIG. 1 is a perspective view of a junction block mounted on one type of junction block support structure and incorporating the principles of the invention.

FIG. 1 shows an illustrative embodiment of the invention in which an electrical junction block housing 100 is supported on a structural member 106 by means of L-shaped mounting lugs 121, 122 on the housing 100 engaging cooperating L-shaped brackets 124, 125 attached to the structural member 106. The structural member 106 may, for example, be the upper wall of a raceway in a wall panel or the like. Housing 100 includes a substantially horizontally extending lower wall 101 and a substantially parallel upper wall 102 interconnected by means of a vertical wall 103 which serves to divide a spatial area 105 from a similar area on the opposite side of wall 103. The spatial areas may be used to accommodate electrical outlet boxes or the like. The junction block housing 100 may be connected to electrical circuits by means of an electrical connector 109 and/or by means of the wiring opening 104.

The housing 100 is maintained in position relative to the structural member 106 by engagement of a retaining tab 120 with the latching device 110 disposed between the mounting lugs 121, 122 on upper wall 102 of the housing 100. The support brackets 124, 125 and the tab 120 may be formed from a plate 130 attached to the structural member 106.

Figure 2:
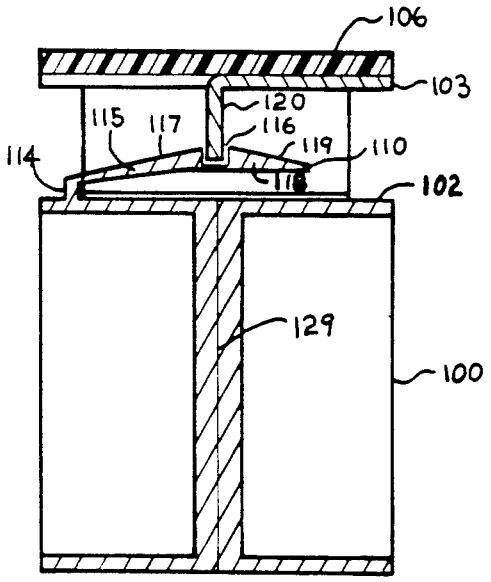
FIG. 2 is a cross-sectional view along line 2—2 of FIG. 1.

As may be more clearly seen with reference to FIG. 2, the latching member 110 is constructed as a cantilever beam having one end attached to a hinge section 114, which in turn is attached to the upper wall 102 of the housing 100. The latch 110 is preferably made integral with the housing 100 and may be constructed of a resilient plastic material, such as a polycarbonate, providing a restoring force at the hinged section 114 in a direction away from the upper wall 102. The housing 100 may be a bipartite structure formed of two separate sections and joined along centerline 129. The latch member 110 is formed on one of the housing sections.

The latch 110 comprises a first arm section 115 having a sloping surface 117 sloping upwardly away from upper wall 102 and away from hinged section 114 toward a slotted section provided with a transversely extending channel 116. The channel 116 engages tab 120 or a similar structural device to prevent lateral movement of the junction block relative to structural member 106. The latch device 110 is further provided with a second arm section 118 extending beyond the channel 116 and having a sloping surface 119 sloping downwardly toward upper wall 102 and away from channel 116.

Referring to FIGS. 1 and 2, it will be apparent that the housing 100 can be slidably removed from engagement with the structural member 106 by pivotal movement of the latch member 110 about the hinged section 114 in the direction of the upper wall of the junction block. Such movement can be achieved from either side of the structural member 106 by manually exerting pressure on the first arm section 115 from one side of the structure or manually exerting pressure on the second arm section 118 from the other side of the structure.

The housing 100 may be installed on the structural member 106 by engagement of the mounting lugs 121, 122 with the support brackets 124 or, 125 from either side of the support structure 106. As the housing 100 approaches the structural member 106 from one side, e.g. the frontal side of the structure depicted in FIG. 1, the tab 120 engages sloping surface 119 of arm section 118 to force the latching member 110 to be deflected about pivot end 114 and in the direction of the upper wall 102 until the tab 120 reaches channel 116. At that point, any further movement of the housing 100 in the sam direction will cause the latch member 110 to pivot in the direction away from upper wall 102 and toward the tab 120, thereby assuring secure engagement between the tab 120 and the latch member 110. Similarly, if the housing 100 is brought into engagement with the structural member 106 from an opposite direction, the inclined surface 117 of arm section 115 will contact the tab 120. As a result, the latch member 110 will be deflected and the tab 120 will eventually engage the channel 116. In that position, further movement of the housing 100 with respect to the structural member 106 is prevented until the latch member 110 is again depressed in the direction of wall 102.

Figure 3:
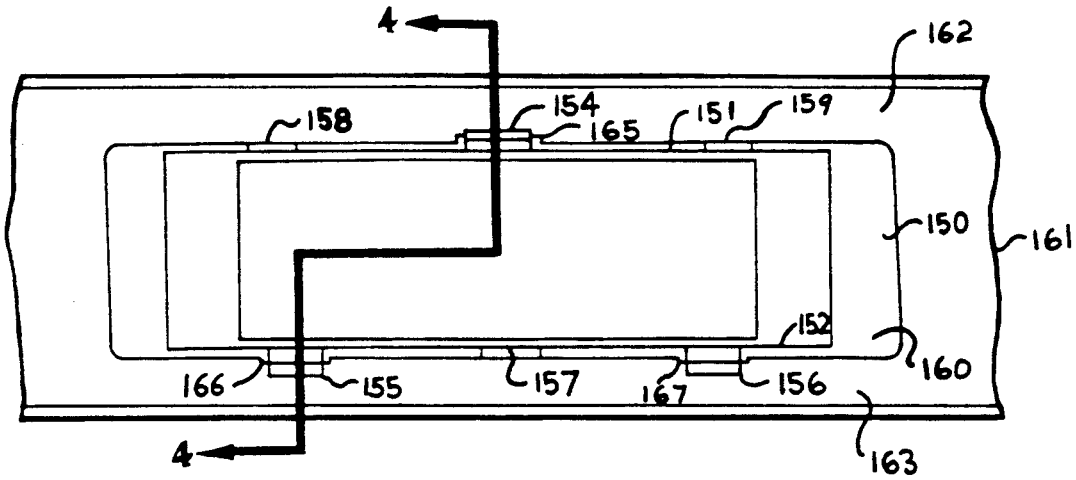
FIG. 3 is a side view of a junction block mounted on another type of junction block support structure and incorporating the principles of the invention.

FIG. 3 is a side view of a junction block 150 mounted within the opening 160 within a frame 161. The junction block 150 is provided with an upper wall 151 and a lower wall 152. Mounted on the upper wall is a latch member 154 positioned for engagement with an upper rail 162 of the structural member 161. Further latching members 155 and 156 are mounted on the lower wall 152 and are positioned with engagement with a lower rail 163 of the structural member 161. The upper rail 162, in this particular example, is provided with a detent 165 in the area where the latching member 154 engages the upper rail. Similarly, the lower rail 163 is provided with detents 166 and 167 in the vicinity of latching members 155 and 156, respectively. One or more of these detents may be conveniently provided to prevent movement of the junction block. A pair of spacing shoulders 158, 159, disposed in substantial alignment with channel 174 (FIG. 4), are provided on upper wall 151. These serve to reduce movement of the junction block and to better secure the junction block between the upper and lower rails 162, 163. A similar shoulder 157 may be provided on the lower wall 152. Alternatively, one of the walls 151, 152 may be provided with one or more engagement tabs, such as tab 200 shown in FIG. 5.

Figure 4:
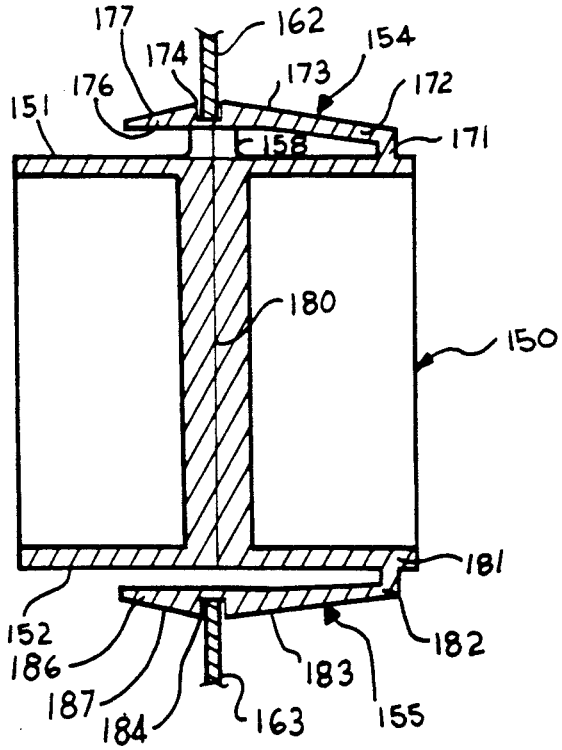
FIG. 4 is an enlarged cross-sectional view along line 4—4 of FIG. 3.

FIG. 4 is a cross-sectional view along line 4—4 of FIG. 3. FIG. 4 shows the upper latch member 154 and lower latch member 155. The upper latch 154 is constructed as a cantilevered beam having one end attached to the upper wall 151 of the junction block 150. Similarly, the latch member 155 is constructed as a cantilever beam attached to the lower wall 152 of the junction block 150. Preferably, the latch members 154, 155 and 156 are formed integral with the junction block 150. The junction block 150 may be conveniently constructed as a bipartite housing having two separately molded half sections which are joined along the vertical center line 180. In this arrangement, the right-hand half section of the junction block 150, as shown in FIG. 4, will include both the upper and lower cantilever beams. Alternatively, the cantilever beams 154, 156 may be arranged such that one of them is integral with one half section and the other is integral with the other half section of the junction block 150.

The latch member 154 is attached to upper wall 151 via hinged section 171 and comprises a first arm section 172, having a sloping surface 173 extending in a direction away from the hinged section 171 and upper wall 151 toward a slotted section provided with a transversely extending channel 174. The latch member 154 is further provided with a second arm section 176 having a sloping surface 177 extending from the channel 174 and in a direction away from the hinged section 171 and toward the upper wall 151. Similarly, the latch member 155 is provided with a hinged section 181 which attaches to or is formed integral with the lower wall 151. A first arm section 182 extends from the hinged section 181 and is provided with a sloping surface 183 extending in a direction away from the hinged section 181 and away from the lower wall 152 and toward a slotted section provided with a transversely extending channel 184. A second arm section 186 extends away from the channel 184 and is provided with a sloping surface 187 sloping away from the hinged section 181 and toward the lower surface 152. The channels 174 and 184 engage the upper rail 162 and lower rail 163, respectively, of the support structure 161.

Removal of the junction block 150 from the support structure 161 may be readily accomplished by either reaching down from an area above the junction block 150 and depressing either the arm section 182 or 186 of the lower latch member 155 and corresponding portions of lower latch member 156 to disengage the lower latch members from the lower rail 163. This will allow the junction block to be pivoted about the upper rail 162 and will allow removal in either direction. Alternatively, the junction block 150 may be removed by depressing one of the arm members 172, 176 of the upper latch member 154 to disengage the latch member from upper rail 162. This will allow the block 150 to pivot about the lower rail 163 and the junction block 150 may be conveniently removed in either direction. The particular embodiment of FIGS. 3 and 4 has the advantage that one can reach down from above or from below or from a lateral position to remove the junction block in a convenient manner. It will be understood that the arrangement will function just as well with a single lower latch member rather than the two latch members 155 and 156 shown in the drawing. Alternatively, only a single latch member may be used on only one of the walls of the junction block engaging either the upper or lower rail and an appropriate slot or bracket in the opposite wall for engagement with the other rail such that by operating the latch member, the junction block may be allowed to pivot on the other rail for convenient insertion and removal while providing secure engagement with both rails when the junction block is properly installed.

Figure 5:
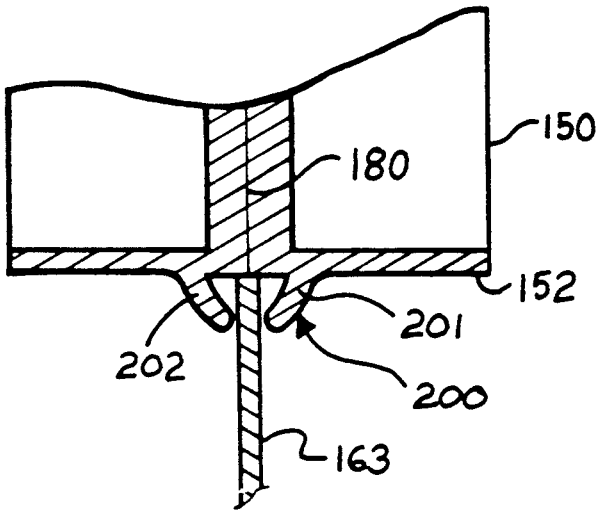
FIG. 5 is a partial cross-sectional view of an alternate embodiment of the junction block of FIG. 3.

FIG. 5 shows a cross-sectional view of an alternate embodiment employing an engagement tab 200 on one of the walls of the junction block 150. By way of example, the junction block 150 may be provided with a latch member 154 on its upper wall and a tab 200 on its lower wall. The tab 200 is provided with a pair of arms 201, 202 which are spaced apart to allow tab 200 to extend over a portion of the lower rail 163. In this manner, tab 200 serves to retain block 150 in proper position relative to lower rail 163 while allowing a pivoting of block 150 during insertion and removal. One or more spacing shoulders such as shoulders 158, 159 may be used on the upper surface 151 of housing 150. However, a spacing shoulder on the lower surface 152, such as shoulder 157, will generally not be used with tab 200.

Figure 6:
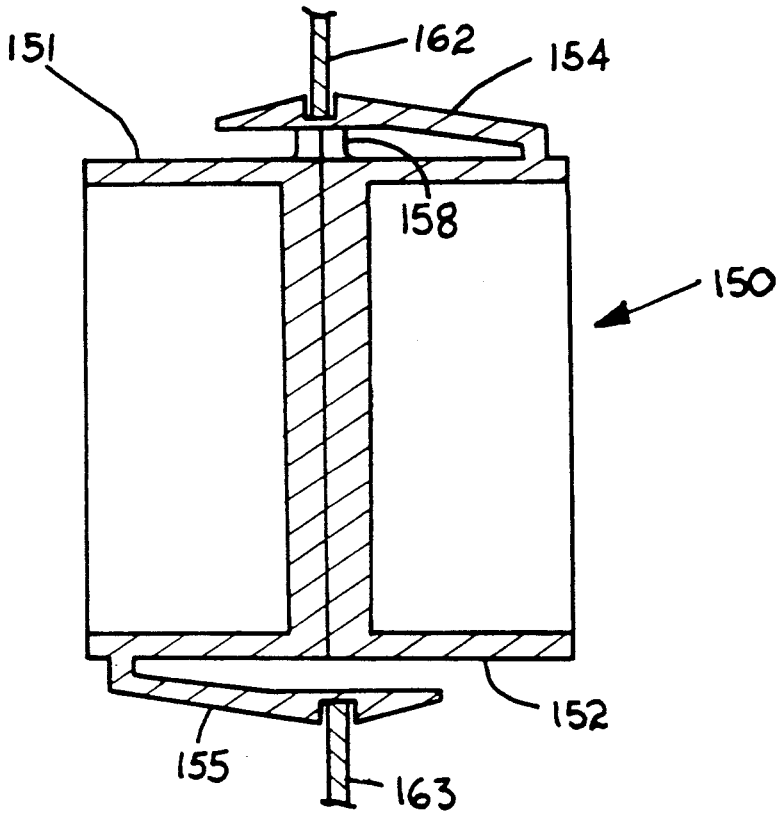
FIG. 6 is an enlarged cross sectional view along line 4—4 of FIG. 3 of an alternate arrangement of the latch member on the lower wall of the junction block.

FIG. 6 is a further cross-sectional view along line 4—4 of FIG. 3, showing an alternate arrangement wherein latch members 154 and 155 are formed on opposite parts of the bipartite housing 150.

It will be understood that the above-described embodiments are illustrative of the invention and that numerous other configurations can be derived by those skilled in the art without departing from the spirit and scope of the invention.

What is claimed is:

1. An electrical connection member for mounting on a structural support member, said connection member comprising:

a housing having at least one outer wall having spaced apart opposite side edges equidistant from a longitudinal centerline of said housing; and a latch member on said outer wall comprising a cantilever beam extending over a portion of said outer wall and having a proximal end hingedly attached to said outer wall and a free distal end terminating between said centerline and one of said side edges, said cantilever beam comprising:

a hinge section at said proximal end attached to said outer wall adjacent another of said side edges;

a slotted section having continuous opposing side walls and defining a transversely extending channel in said cantilever beam in substantial alignment with said centerline for latching engagement with said support structure;

a first arm section extending between said hinge section and said slotted section and having a first surface adjacent said outer wall and a second surface opposite said first surface, said second surface sloping away from said hinge section and away from said outer wall; and a second arm section extending away from said hinge section and said slotted section and having a first surface adjacent said outer wall and second surface opposite said first surface of said second arm section, said second surface of said second arm section sloping away from said slotted section and toward said outer surface.

2. The connection member in accordance with claim 1 wherein said housing comprises an other outer wall opposite said at least one outer wall and a latch member on said other outer wall comprising an other cantilever beam having one end attached to said other outer wall and extending over a portion of said other outer wall, said other cantilever beam comprising:

a beam hinge section at said one end of said other cantilever beam and attached to said other outer wall;

a slotted beam section defining a transversely extending channel in said other cantilever beam for latching engagement with said support structure;

a first beam arm section extending between said beam hinge section and said slotted beam section and having a lower surface adjacent said other outer wall and an upper surface opposite said lower surface of said first beam section, said upper surface of said first beam section sloping away from said beam hinge section and away from said other outer wall; and a second beam arm section extending away from said beam hinge section and said slotted beam section and having a lower surface adjacent said other outer wall and upper surface opposite said lower surface of said second beam arm section, said upper surface of said second beam arm section sloping away from said slotted beam section and said beam hinge section and toward said other outer wall.

3. The connection member in accordance with claim 2 wherein said housing comprises a bipartite housing and wherein one of said cantilever beams is formed integral with each said housing.

4. The connection member in accordance with claim 2 wherein said housing comprises two housing parts and wherein both of said cantilever beams are formed integral with one of said housing parts.

5. The connection member in accordance with claim 1 wherein said hinge sections are constructed of a material having resilient properties providing a restoring force to said cantilever beam when said cantilever beam is moved toward said outer surface.

6. An electrical junction block housing adapted for attachment to a support structure, said housing comprising:

an outer wall having spaced apart opposite side edges equidistant from a longitudinally extending centerline of said housing;

a pair of spaced-apart, substantially L-shaped attachment lugs extending outwardly from said outer wall for engagement with corresponding support brackets on said support structure; and a latch member on said outer wall comprising a cantilever beam extending over a portion of said outer wall and having a proximal end hingedly attached to said outer wall and a free distal end terminating between said centerline and one of said side edges, said cantilever beam comprising:

a hinge section at said proximal end and attached to said outer wall adjacent another of said side edges;

a slotted section defining a transversely extending channel in said cantilever beam in substantial alignment with said centerline for engagement with a retaining member on said support structure;

a first arm section extending between said hinge section and said slotted section and having a first surface adjacent said outer surface and a second surface opposite said first surface, said second surface sloping away from said hinge section toward said slotted section and away from said outer wall; and a second arm section extending away from said hinge section and said slotted section and having a first surface adjacent said outer wall and a second surface opposite said first surface of said second arm section, said second surface of said second arm section sloping away from said slotted section and toward said outer surface.

7. The junction block housing in accordance with claim 6 wherein said latch member is disposed between said attachment lugs.

8. An electrical junction block adapted for mounting between spaced-apart, opposing support rails and comprising:

a housing having first and second opposite outer walls and a rail engaging arrangement on each of said outer walls, said outer walls each comprising first and second opposite side edges equidistant from a longitudinal center line of said housing, said rail engaging arrangement on said first outer wall comprising a cantilever beam extending over a portion of said first outer wall and having a proximal end hingedly attached to said first outer wall and a free distal end terminating between said centerline and one of said side edges of said first outer wall, said cantilever beam comprising:

a slotted section defining a transversely extending channel in said cantilever beam in substantial alignment with said centerline for engagement with one of said support rails;

a hinge section at said proximal end and attached to said outer wall adjacent another of said side edges of said first outer wall;

a first arm section extending between said hinge section and said slotted section and having a first surface adjacent said first outer wall and a second surface opposite said first surface, said second surface sloping away from said hinge section and away from said outer wall; and a second arm section extending away from said slotted section and said hinge section and having a first surface adjacent said first outer wall and a second surface opposite said first surface of said second arm section, said second surface of said second arm section sloping away from said slotted section and said hinge section and toward said first outer wall.

9. The junction block in accordance with claim 8 wherein said rail engaging arrangement on said second outer wall comprises another cantilever beam having one end attached to said second outer wall and extending over a portion of said second outer wall, said second cantilever beam comprising:

a slotted beam section defining a transversely extending channel in said other cantilever beam for engagement with another of said support rails;

a beam hinge section at said one end of said other cantilever beam and attached to said second outer wall;

a first beam arm section extending between said beam hinge section and said slotted beam section and having a lower surface adjacent said second outer wall and an upper surface opposite said lower surface of said first beam arm section, said upper surface of said first beam arm section sloping away from said beam hinge section and away from said second outer wall; and a second beam arm section extending away from said beam hinge section and said slotted beam section and having a lower surface adjacent said second outer wall and an upper surface opposite said lower surface of said second beam arm section, said upper surface of said second beam arm section sloping away from said slotted beam section and said beam hinge section and toward said second outer wall.

10. The electrical junction block in accordance with claim 8 wherein said rail engaging arrangement on said second surface comprises a cantilever beam having a transversely extending channel for engaging another of said support rails.

11. The electrical junction block in accordance with claim 8 wherein said rail engaging arrangement on said second surface comprises a pair of substantially parallel cantilever beams each provided with a slotted section for engagement with another of said support rails.

12. The electrical junction block in accordance with claim 8 wherein said rail engaging arrangement on said first outer wall further comprises at least one spacing shoulder extending outwardly from said first outer wall in substantial alignment with said transversely extending channel.

13. The electrical junction block in accordance with claim 8 wherein said rail engaging arrangement on said second outer wall comprises an engagement tab having a pair of spaced-apart arms for extending over a portion of one of said opposing support rails to retain said junction block in proper position relative to said one of said support rails.

* * * * *

UNITED STATES PATENT AND TRADEMARK OFFICE

CERTIFICATE OF CORRECTION

PATENT NO. : 5,259,787

DATED : November 9, 1993

INVENTOR(S) : Norman R. Byrne

It is certified that error appears in the above-indentified patent and that said Letters Patent is hereby corrected as shown below:

Col. 6, claim 2, line 33:
after "comprising" delete "an other" and insert --another--.

Col. 6, claim 3, line 61:
after "one" insert --part--.

Signed and Sealed this

Eighteenth Day of April, 1995

Bruce Lehman

*Attest:*

BRUCE LEHMAN

*Commissioner of Patents and Trademarks*

*Attesting Officer*